US009907371B2

(12) United States Patent
Ross

(10) Patent No.: US 9,907,371 B2
(45) Date of Patent: Mar. 6, 2018

(54) MONEY CLIP DEVICE

(71) Applicant: Travis L. Ross, Matthews, NC (US)

(72) Inventor: Travis L. Ross, Matthews, NC (US)

(73) Assignee: Truth By Design, LLC, Matthews, NC (US)

( * ) Notice: Subject to any disclaimer, the term of this patent is extended or adjusted under 35 U.S.C. 154(b) by 0 days.

(21) Appl. No.: 14/519,498

(22) Filed: Oct. 21, 2014

(65) Prior Publication Data

US 2015/0107057 A1 Apr. 23, 2015

Related U.S. Application Data

(60) Provisional application No. 61/893,507, filed on Oct. 21, 2013.

(51) Int. Cl.
*A45C 1/06* (2006.01)
*B42F 1/02* (2006.01)

(52) U.S. Cl.
CPC ..... *A45C 1/06* (2013.01); *B42F 1/02* (2013.01); *A45C 2001/062* (2013.01); *Y10T 24/20* (2015.01); *Y10T 24/205* (2015.01)

(58) Field of Classification Search
CPC ..... A45C 1/06; A45C 2001/062; A45C 2001/065; A45C 2001/067; B42F 1/02; B42F 1/04; B42F 1/10; Y10T 24/44829; Y10T 24/1406; Y10T 24/1408; Y10T 24/1394; Y10T 24/20; Y10T 24/205; A45F 5/00; A45F 2200/055
See application file for complete search history.

(56) References Cited

U.S. PATENT DOCUMENTS

| | | | | | |
|---|---|---|---|---|---|
| 510,621 | A | * | 12/1893 | Van Derveer | 24/17 R |
| 675,318 | A | * | 5/1901 | Boothe | 24/17 A |
| 738,462 | A | * | 9/1903 | Lincoln | 294/146 |
| 929,952 | A | * | 8/1909 | Johnson | 24/17 R |
| 1,006,584 | A | * | 10/1911 | Millsaps | 24/17 A |
| 3,861,002 | A | * | 1/1975 | Gordon | 24/336 |
| 4,420,104 | A | * | 12/1983 | DiIenno | A45F 5/021 224/250 |
| 4,982,885 | A | * | 1/1991 | Severson | A45C 13/30 224/250 |
| 5,077,869 | A | * | 1/1992 | Haase | 24/336 |

(Continued)

*Primary Examiner* — Robert J Sandy
*Assistant Examiner* — Rowland Do
(74) *Attorney, Agent, or Firm* — Clements Bernard Walker PLLC; Christopher L. Bernard

(57) ABSTRACT

A money clip device, including: a central body portion; and three or more elongate arm portions extending radially from the central body portion and configured to retain an item to be held. The central body portion and the three or more elongate arm portions collectively define a space in which the item to be held is retained. Optionally, the money clip device also includes a wallet insert disposed within the central body portion and the three or more elongate arm portions. Optionally, at least one of the three or more elongate arm portions is manufactured from a substantially flexible material and comprises a pull tab by which the elongate arm portion may be grasped by a user. The money clip device further includes a decorative insignia disposed on one or more of the central body portion and the three or more elongate arm portions.

12 Claims, 3 Drawing Sheets

(56) References Cited

U.S. PATENT DOCUMENTS

| | | | | |
|---|---|---|---|---|
| 5,535,928 | A * | 7/1996 | Herring | A45F 5/021 224/250 |
| D390,493 | S * | 2/1998 | Fletcher | D11/78.1 |
| D393,813 | S * | 4/1998 | Herdt | D11/78.1 |
| 6,247,623 | B1 * | 6/2001 | Walters | F41C 33/0236 224/255 |
| 6,357,084 | B1 * | 3/2002 | Haidon | 24/3.12 |
| D467,069 | S * | 12/2002 | TenHoeve | D3/218 |
| 6,708,375 | B1 * | 3/2004 | Johnson | 24/17 A |
| 6,751,103 | B1 * | 6/2004 | Sivertsen | 361/825 |
| 7,125,049 | B2 * | 10/2006 | Goldberg et al. | 281/42 |
| 7,464,975 | B1 * | 12/2008 | Cox | 294/138 |
| 7,640,632 | B2 * | 1/2010 | Lazarus | A45C 1/02 150/143 |
| D645,085 | S * | 9/2011 | Jung | D19/65 |
| 2005/0071956 | A1 * | 4/2005 | Fuller | A45C 15/00 24/17 B |

* cited by examiner

MONEY CLIP DEVICE

CROSS-REFERENCE TO RELATED APPLICATION

The present patent application/patent claims the benefit of priority of U.S. Provisional Patent Application No. 61/893,507, filed on Oct. 21, 2013, and entitled "MONEY CLIP DEVICE," the contents of which are incorporated in full by reference herein.

BACKGROUND OF THE INVENTION

Various wallets and money clips are known to those of ordinary skill in the art for holding ones paper money, credit cards, license, and/or the like. Typically, such wallets include bi-fold and tri-fold wallets, and such money clips include two-arm pinch clips. Often, these wallets and money clips are embroidered, embossed, or adorned with various insignia on the outside thereof. As such, these wallets and money clips act as a fashion accessory. Problematically, the wallets can be bulky and cumbersome to use, while the money clips may inadequately secure ones valuables.

Thus, what is still needed in the art is a money clip device that is streamlined, easy to use, and that adequately secures ones valuables. Preferably, this money clip device could be embroidered, embossed, or adorned with various insignia on the outside thereof and act as a fashion accessory, just as known wallets and money clips are and do.

BRIEF SUMMARY OF THE INVENTION

In various exemplary embodiments, the present invention provides a money clip device that is streamlined, easy to use, and that adequately secures ones valuables. Advantageously, this money clip device may be embroidered, embossed, or adorned with various insignia on the outside thereof and act as a fashion accessory, just as known wallets and money clips are and do. The money clip device includes a central body portion disposed on either side of a wallet insert or personal item to be held. Either three or four elongate arm portions extend radially outwards from the central body portion, in front of and behind the personal item to be held, thereby securing the personal item to be held. The money clip device may be manufactured from a substantially rigid material, such as metal or plastic, or the money clip device may be manufactured from a substantially flexible material, such as rubber. In the three-arm embodiment, for example, the money clip device is manufactured from either a substantially rigid material or a substantially flexible material and one side of the money clip device is left open, such that the personal item to be held may be inserted into the money clip device. In the four-arm embodiment, for example, the money clip device is manufactured from a substantially flexible material (at least in part) and one side of the money clip device includes a deflectable arm including a pull tab that may be deflected to the side such that the personal item to be held may be inserted into the money clip device.

In one exemplary embodiment, the present invention provides a money clip device, comprising: a central body portion; and three or more elongate arm portions extending radially from the central body portion and configured to retain a item to be held. Optionally, the central body portion includes a front piece and a back piece. The three or more elongate arms couple the front piece of the central body portion to the back piece of the central body portion. The central body portion and the three or more elongate arm portions collectively define a space in which the item to be held is retained. Optionally, the money clip device also comprises a wallet insert disposed within the central body portion and the three or more elongate arm portions. Optionally, at least one of the three or more elongate arm portions is manufactured from a substantially flexible material. Optionally, at least one of the three or more elongate arm portions comprises a pull tab by which the elongate arm portion may be grasped by a user. The money clip device further comprises a decorative insignia disposed on one or more of the central body portion and the three or more elongate arm portions.

In another exemplary embodiment, the present invention provides a method for providing a money clip device, comprising: providing a central body portion; and providing three or more elongate arm portions extending radially from the central body portion and configured to retain a item to be held. Optionally, the central body portion includes a front piece and a back piece. The three or more elongate arms couple the front piece of the central body portion to the back piece of the central body portion. The central body portion and the three or more elongate arm portions collectively define a space in which the item to be held is retained. Optionally, the money clip device also comprises a wallet insert disposed within the central body portion and the three or more elongate arm portions. Optionally, at least one of the three or more elongate arm portions is manufactured from a substantially flexible material. Optionally, at least one of the three or more elongate arm portions comprises a pull tab by which the elongate arm portion may be grasped by a user. The money clip device further comprises a decorative insignia disposed on one or more of the central body portion and the three or more elongate arm portions.

BRIEF DESCRIPTION OF THE DRAWINGS

The present invention is illustrated and described herein with reference to the various drawings, in which like reference numbers are used to denote like device components, as appropriate, and in which.

DETAILED DESCRIPTION OF THE INVENTION

Again, in various exemplary embodiments, the present invention provides a money clip device that is streamlined, easy to use, and that adequately secures ones valuables. Advantageously, this money clip device may be embroidered, embossed, or adorned with various insignia on the outside thereof and act as a fashion accessory, just as known wallets and money clips are and do. The money clip device includes a central body portion disposed on either side of a wallet insert or personal item to be held. Either three or four elongate arm portions extend radially outwards from the central body portion, in front of and behind the personal item to be held, thereby securing the personal item to be held. The money clip device may be manufactured from a substantially rigid material, such as metal or plastic, or the money clip device may be manufactured from a substantially flexible material, such as rubber. In the three-arm embodiment, for example, the money clip device is manufactured from either a substantially rigid material or a substantially flexible material and one side of the money clip device is left open, such that the personal item to be held may be inserted into the money clip device. In the four-arm embodiment, for example, the money clip device is manufactured from a substantially flexible material (at least in part) and one side of the money clip device includes a deflectable arm including a pull tab that may be deflected to the side such that the personal item to be held may be inserted into the money clip device.

Figure 1:
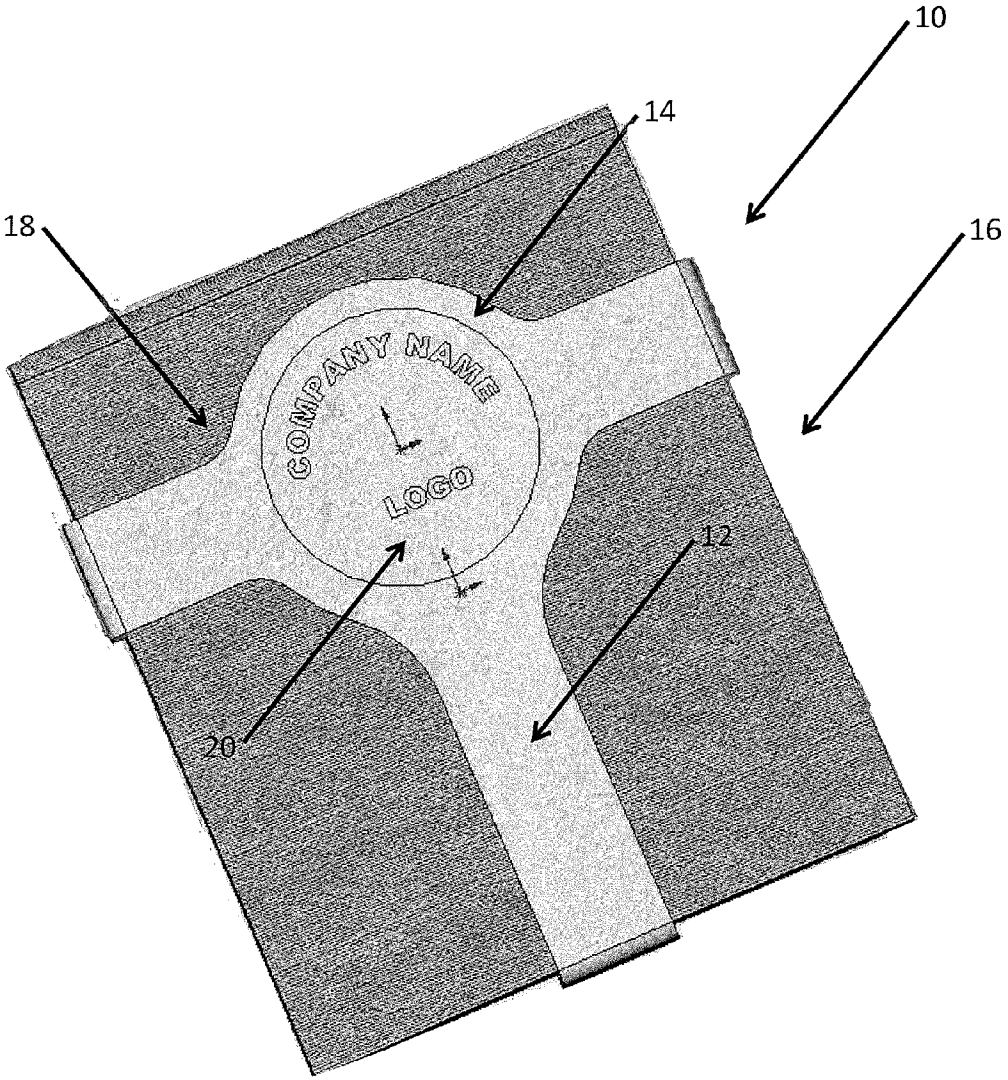
FIG. 1 is a planar diagram illustrating one exemplary (three-arm) embodiment of the money clip device of the present invention, illustrating the use of the money clip device with a wallet insert or personal item to be held.
Figure 2:
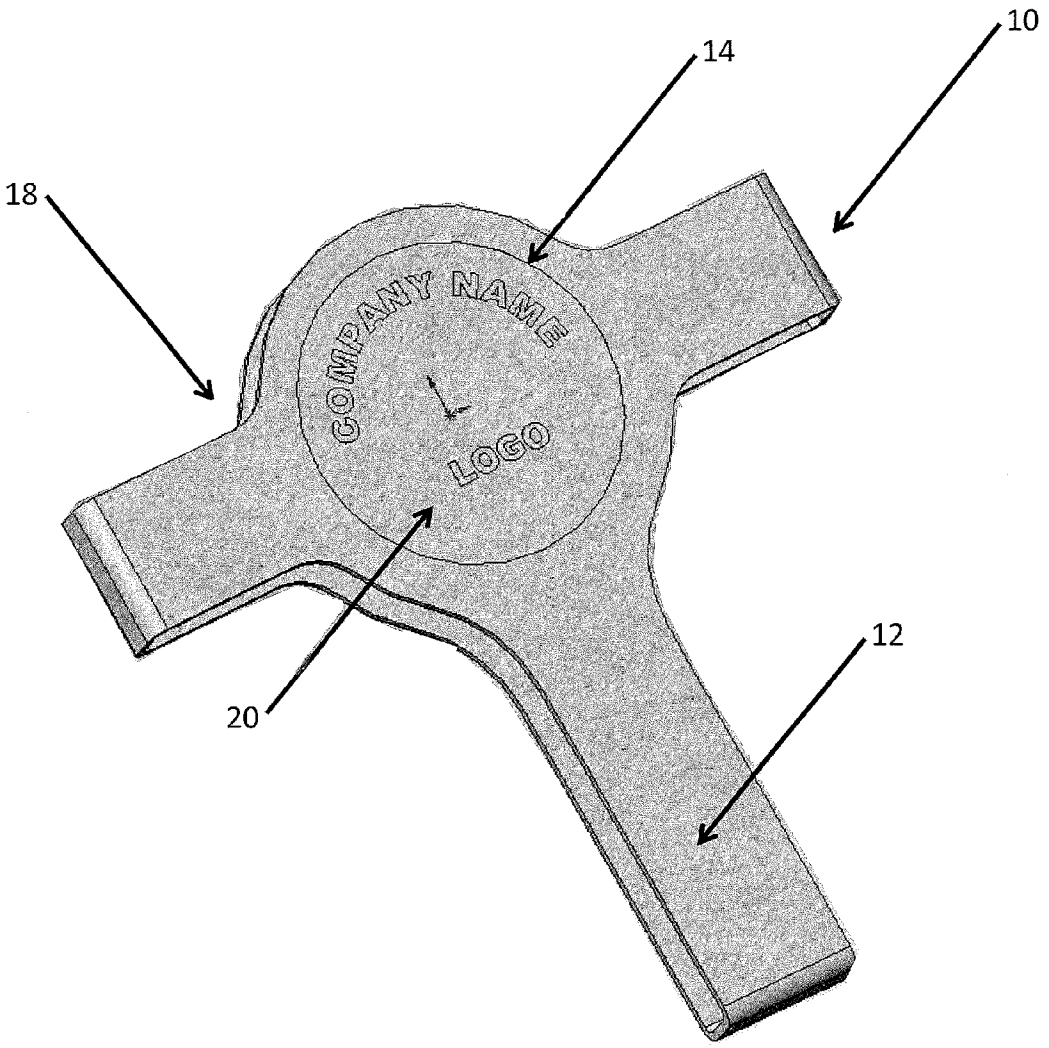
FIG. 2 is a perspective diagram illustrating one exemplary (three-arm) embodiment of the money clip device of the present invention.

Referring now specifically to FIGS. 1 and 2, in one exemplary (three-arm) embodiment, the money clip device 10 includes elongate arm portions 12 that extend radially outwards from the central body portion 14, in front of and behind the wallet insert or personal item to be held 16 (FIG. 1), thereby securing the wallet insert or personal item to be held 16. Typically, the wallet insert or personal item to be held 16 has a substantially square or rectangular shape. In this exemplary embodiment, the central body portion 14 has a substantially circular shape, although it will be readily apparent to those of ordinary skill in the art that any suitable shape may be utilized. The central body portion 14 may also simply include the intersection of the elongate arm portions 12. Likewise, the elongate arm portions 12 each have a substantially rectangular shape, although it will be readily apparent to those of ordinary skill in the art that any suitable shape may be utilized. The money clip device 10 may be manufactured from a substantially rigid material, such as metal or plastic, or the money clip device 10 may be manufactured from a substantially flexible material, such as rubber. In this exemplary embodiment, for example, the money clip device 10 is manufactured from either a substantially rigid material or a substantially flexible material and one side 18 of the money clip device 10 is left open, such that the wallet insert or personal item to be held 16 may be inserted into the money clip device 10. In general, the central body portion 14 and elongate arm portions 12 of the money clip device 10 define an internal space in which the wallet insert or personal item to be held 16 are disposed. The money clip device 10 may be embroidered, embossed, or adorned with various insignia 20 on the outside thereof and act as a fashion accessory, just as known wallets and money clips are and do.

In the event that the wallet insert 16 is used to hold the personal item to be held 16, the wallet insert 16 may include a conventional bi-fold or tri-fold wallet, a conventional card holder, etc., optionally made of leather, nylon, or another suitable material.

Figure 3:
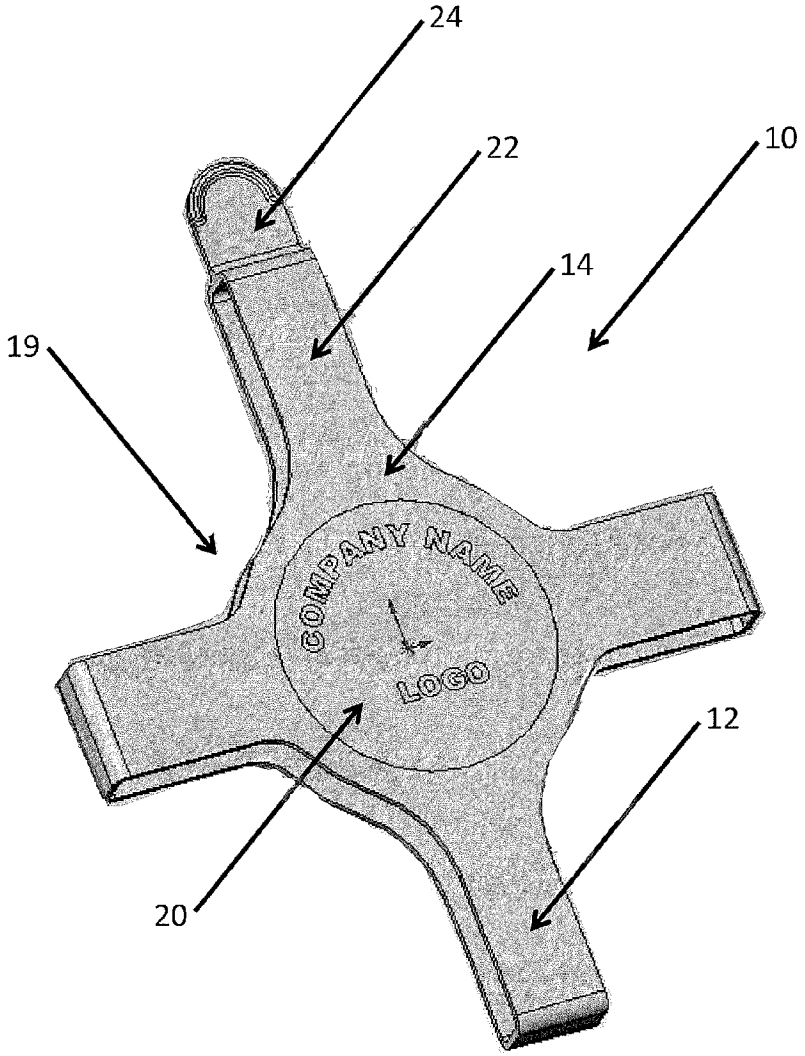
FIG. 3 is a perspective diagram illustrating one exemplary (four-arm) embodiment of the money clip device of the present invention.

Referring now specifically to FIG. 3, in another exemplary (four-arm) embodiment, the money clip device 10 includes elongate arm portions 12 that extend radially outwards from the central body portion 14, in front of and behind the wallet insert or personal item to be held 16 (FIG. 1), thereby securing the wallet insert or personal item to be held 16. Typically, the wallet insert or personal item to be held 16 has a substantially square or rectangular shape. In this exemplary embodiment, the central body portion 14 has a substantially circular shape, although it will be readily apparent to those of ordinary skill in the art that any suitable shape may be utilized. The central body portion 14 may also simply include the intersection of the elongate arm portions 12. Likewise, the elongate arm portions 12 each have a substantially rectangular shape, although it will be readily apparent to those of ordinary skill in the art that any suitable shape may be utilized. The money clip device 10 may be manufactured from a substantially rigid material, such as metal or plastic, or the money clip device 10 may be manufactured from a substantially flexible material, such as rubber. In this exemplary embodiment, for example, the money clip device 10 is manufactured from a substantially flexible material (at least in part) and one side 19 of the money clip device 10 includes a deflectable arm 22 including a pull tab 24 that may be deflected to the side such that the wallet insert or personal item to be held 16 may be inserted into the money clip device 10. In general, the central body portion 14 and elongate arm portions 12 and 22 of the money clip device 10 define an internal space in which the wallet insert or personal item to be held 16 are disposed. The money clip device 10 may be embroidered, embossed, or adorned with various insignia 20 on the outside thereof and act as a fashion accessory, just as known wallets and money clips are and do.

It should be noted that the money clip device 10 is manufactured in the same manner as conventional money clip devices, having a relatively thin construction, such that the footprint of the money clip device 10 is small. The money clip device 10 can be molded, formed, etc.

Although the present invention is illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A money clip device, comprising:

an enlarged front piece of a central body portion having a substantially circular shape disposed in front of an item to be held and an enlarged back piece of the central body portion having a substantially circular shape disposed behind the item to be held; and three or more elongate arm portions disposed both in front of and behind the item to be held extending radially from the enlarged front and back pieces of the central body portion and configured to retain the item to be held;

wherein a diameter or width of each of the enlarged front and back pieces of the central body portion is greater than a width of each of the three or more elongate arm portions both in front of and behind the item to be held;

wherein the enlarged front and back pieces of the central body portion and the three or more elongate arm portions are each substantially rigid and are molded together to form a single unitary substantially rigid money clip device having a fixed shape and the enlarged front and back pieces of the central body portion hold the three or more elongate arm portions in non-pivoting alignment; and wherein the enlarged front and back pieces of the central body portion and the three or more elongate arm portions define an internal space in which the item to be held is disposed.

2. The money clip device of claim 1, wherein the three or more elongate arm portions couple the front piece of the central body portion to the back piece of the central body portion.

3. The money clip device of claim 1, wherein the central body portion and the three or more elongate arm portions collectively define a space in which the item to be held is retained.

4. The money clip device of claim 1, further comprising a wallet insert disposed within the central body portion and the three or more elongate arm portions.

5. The money clip device of claim 1, wherein at least one of the three or more elongate arm portions comprises a pull tab by which the elongate arm portion may be grasped by a user.

6. The money clip device of claim 1, further comprising a decorative insignia disposed on one or more of the central body portion and the three or more elongate arm portions.

7. A method for providing a money clip device, comprising:

providing an enlarged front piece of a central body portion having a substantially circular shape disposed in front of an item to be held and an enlarged back piece of the central body portion having a substantially circular shape disposed behind the item to be held; and providing three or more elongate arm portions disposed both in front of and behind the item to be held extending radially from the enlarged front and back pieces of the central body portion and configured to retain the item to be held;

wherein a diameter or width of each of the enlarged front and back pieces of the central body portion is greater than a width of each of the three or more elongate arm portions both in front of and behind the item to be held;

wherein the enlarged front and back pieces of the central body portion and the three or more elongate arm portions are each substantially rigid and are molded together to form a single unitary substantially rigid money clip device having a fixed shape and the enlarged front and back pieces of the central body portion hold the three or more elongate arm portions in non-pivoting alignment; and wherein the enlarged front and back pieces of the central body portion and the three or more elongate arm portions define an internal space in which the item to be held is disposed.

8. The method of claim 7, wherein the three or more elongate arm portions couple the front piece of the central body portion to the back piece of the central body portion.

9. The method of claim 7, wherein the central body portion and the three or more elongate arm portions collectively define a space in which the item to be held is retained.

10. The method of claim 7, further comprising providing a wallet insert disposed within the central body portion and the three or more elongate arm portions.

11. The method of claim 7, wherein at least one of the three or more elongate arm portions comprises a pull tab by which the elongate arm portion may be grasped by a user.

12. The method of claim 7, further comprising providing a decorative insignia disposed on one or more of the central body portion and the three or more elongate arm portions.

* * * * *